US009518455B2

(12) United States Patent
Franklin et al.

(10) Patent No.: US 9,518,455 B2
(45) Date of Patent: Dec. 13, 2016

(54) FLOW CONTROL DEVICES AND METHODS OF USE

(71) Applicant: Halliburton Energy Services, Inc., Houston, TX (US)

(72) Inventors: Matthew Earl Franklin, Lewisville, TX (US); Stephen M. Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 497 days.

(21) Appl. No.: 14/111,946

(22) PCT Filed: Dec. 20, 2012

(86) PCT No.: PCT/US2012/070858

§ 371 (c)(1),
(2) Date: Oct. 15, 2013

(87) PCT Pub. No.: WO2014/098862

PCT Pub. Date: Jun. 26, 2014

(65) Prior Publication Data

US 2015/0292300 A1 Oct. 15, 2015

(51) Int. Cl.
*E21B 43/12* (2006.01)
*E21B 34/08* (2006.01)
(Continued)

(52) U.S. Cl.
CPC ..... *E21B 43/12* (2013.01); *E21B 34/08* (2013.01); *E21B 41/00* (2013.01); *E21B 43/08* (2013.01)

(58) Field of Classification Search
CPC ..... E21B 17/18; E21B 34/06; E21B 43/08; E21B 43/12; E21B 41/00
See application file for complete search history.

(56) References Cited

U.S. PATENT DOCUMENTS 5,906,238 A * 5/1999 Carmody ..... E21B 21/10 166/113
7,469,743 B2 * 12/2008 Richards ..... E21B 43/08 166/227

(Continued)

FOREIGN PATENT DOCUMENTS

WO 2014098862 A1 6/2014

OTHER PUBLICATIONS

International Search Report and Written Opinion for PCT/US2012/070858 dated Aug. 27, 2013.

*Primary Examiner* — Robert E Fuller
*Assistant Examiner* — Christopher Sebesta
(74) *Attorney, Agent, or Firm* — McDermott Will & Emery; Scott Richardson

(57) ABSTRACT

Disclosed are improved flow control devices and methods of use thereof. One flow control device includes a body arranged within a cavity defined in a housing coupled to a base pipe, the housing defining a perforation and the base pipe defining one or more flow ports aligned with the perforation to allow fluid communication therethrough, and a flow chamber defined within the body and having a longitudinal portion and a radial portion, the radial portion being fluidly coupled to the perforation such that a fluid flowing through the flow chamber is conveyed directly to or from the perforation and the one or more flow ports.

20 Claims, 3 Drawing Sheets

(51) Int. Cl.
*E21B 43/08* (2006.01)
*E21B 41/00* (2006.01)

(56) References Cited

U.S. PATENT DOCUMENTS

| | | | | |
|---|---|---|---|---|
| 2006/0131033 | A1* | 6/2006 | Bode | E21B 34/08 166/386 |
| 2008/0041580 | A1* | 2/2008 | Freyer | E21B 34/08 166/193 |
| 2008/0283238 | A1* | 11/2008 | Richards | E21B 23/04 166/228 |
| 2009/0008078 | A1 | 1/2009 | Patel | |
| 2011/0198097 | A1 | 8/2011 | Moen | |
| 2011/0297385 | A1* | 12/2011 | Dykstra | E21B 34/06 166/316 |
| 2012/0006563 | A1 | 1/2012 | Patel et al. | |
| 2012/0292116 | A1 | 11/2012 | Schultz et al. | |

* cited by examiner

FLOW CONTROL DEVICES AND METHODS OF USE

The application claims priority to and is a National Stage entry from International Application No. PCT/US2012/70858, filed on Dec. 20, 2012.

BACKGROUND

The present invention generally relates to wellbore flow control devices and, more specifically, to improved flow control devices and methods of use thereof.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

During production operations, tubular and nozzle-type flow restrictors are typically arranged longitudinally in a housing coupled to a base pipe, such as a production tubular. Such flow restrictors generate a large pressure drop across the flow control device in order to regulate fluid flow into the base pipe at that particular location. The fluid discharged from such flow restrictors, however, exit the flow control device at a high velocity fluid, thereby requiring the housing to provide an area where the fluid force may dissipate before entering the production tubing. Without an area used to dissipate the fluid force, the exiting fluid could erode portions of the housing, and thereby potentially result in the failure of the housing by blow out or mechanical failure.

SUMMARY OF THE INVENTION

The present invention generally relates to wellbore flow control devices and, more specifically, to improved flow control devices and methods of use thereof.

In some embodiments, a flow control device is disclosed. The flow control device may include a body arranged within a cavity defined in a housing coupled to a base pipe, the housing defining a perforation and the base pipe defining one or more flow ports aligned with the perforation to allow fluid communication therethrough, and a flow chamber defined within the body and having a longitudinal portion and a radial portion, the radial portion being fluidly coupled to the perforation such that a fluid flowing through the flow chamber is conveyed directly to or from the perforation and the one or more flow ports.

In other embodiments, a method of regulating a fluid flow is disclosed. The method may include receiving a fluid in a flow control device comprising a body arranged within a housing coupled to a base pipe, the housing defining a perforation and the base pipe defining one or more flow ports aligned with the perforation to allow fluid communication therethrough, flowing the fluid through a flow chamber defined within the body, the flow chamber having a longitudinal portion and a radial portion, and conveying the fluid directly to or from the perforation and the one or more flow ports via the radial portion, the radial portion being fluidly coupled to the perforation.

In yet other embodiments, a method of producing a fluid is disclosed. The method may include drawing the fluid through a well screen arranged about a base pipe, the base pipe having one or more flow ports defined therein and a housing coupled thereto, the housing defining a perforation aligned with the one or more flow ports to allow fluid communication therethrough, receiving the fluid in a flow control device comprising a body arranged within the housing, flowing the fluid through a flow chamber defined in the body, the flow chamber having a longitudinal portion and a radial portion, wherein the radial portion is fluidly coupled to the perforation, conveying the fluid directly to the perforation and the one or more flow ports via the radial portion, and receiving the fluid in an interior of the base pipe via the one or more flow ports.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention generally relates to wellbore flow control devices and, more specifically, to improved flow control devices and methods of use thereof.

The exemplary flow control devices disclosed herein may redirect a stream of high-velocity fluid flow such that the fluid is unable to damage a housing that contains the flow control device through erosion or abrasion thereto. Instead, the high-velocity fluid flow is conveyed directly to the base pipe for production purposes, thereby bypassing the need to dissipate the fluid flow before it enters the base pipe. As a result, the exemplary flow control devices may allow the housing to be manufactured to a smaller size, thereby providing a smaller inflow control device package design that decreases manufacturing costs and complexity. Moreover, the smaller package design may prove advantageous in downhole environments where space is often limited and valuable.

Figure 1:
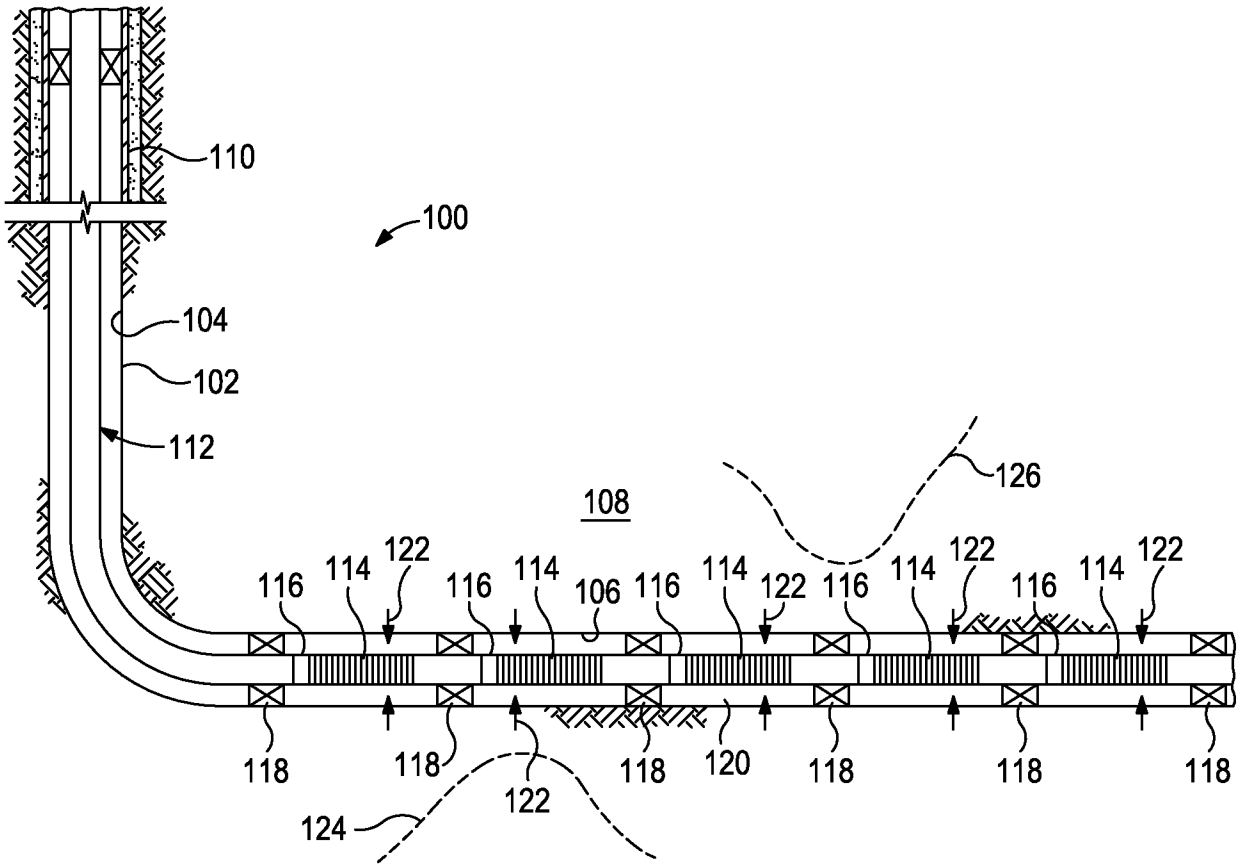
FIG. 1 illustrates a cross-sectional view of a well system which can embody principles of the present disclosure.

Referring to FIG. 1, illustrated is a well system 100 which can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 that has a string of casing 110 cemented therein. A tubular string, such as production tubing or a base pipe 112, may be installed in or otherwise extended into the wellbore 102.

One or more well screens 114, one or more flow control devices 116, and one or more packers 118 may be interconnected along the base pipe 112, such as along portions of the base pipe 112 that extend through the horizontal section 106 of the wellbore 102. The packers 118 may be configured to seal off an annulus 120 defined between the base pipe 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected with the base pipe 112 and positioned between a pair of packers 118. In operation, the well screen 114 may be configured to filter the fluids 122 flowing into the base pipe 112 from the annulus 120. The flow control device 116 may be configured to restrict or otherwise regulate the flow of the fluids 122 into the base pipe 112, such that production from the toe and heel of the well are substantially equalized.

Those skilled in the art will readily appreciate that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

Moreover, it is not necessary for the well screens 114, flow control devices 116, packers 118 or any other components of the base pipe 112 to be positioned in uncased sections 104, 106 of the wellbore 102. Rather, any section of the wellbore 102 may be cased or uncased, and any portion of the base pipe 112 may be positioned in an uncased or cased section of the wellbore 102, without departing from the scope of the disclosure.

Those skilled in the art will readily recognize the advantages of being able to regulate the flow of fluids 122 into the base pipe 112 from each zone of the subterranean formation 108, for example, to prevent the occurrence of water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to fluid flow if a fluid velocity increases beyond a selected level, and thereby balancing flow among production zones which serves to prevent water coning 124 or gas coning 126.

Figure 2:
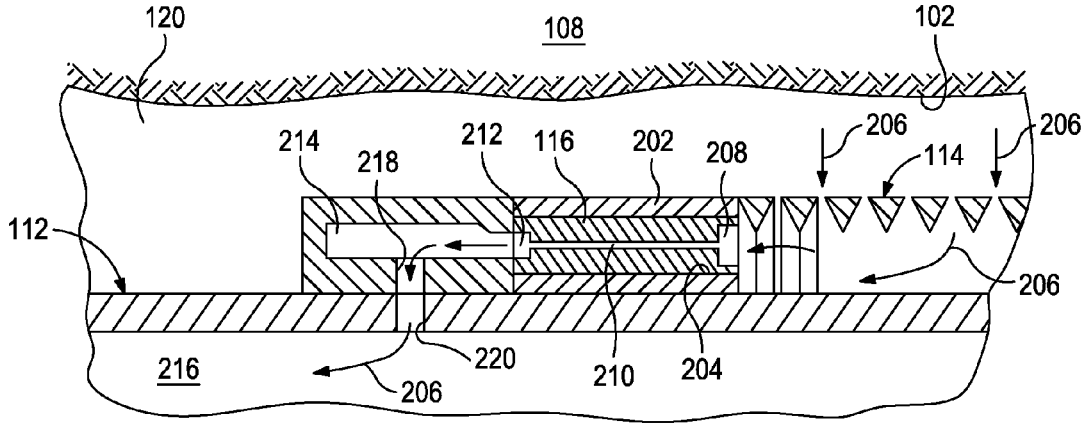
FIG. 2 is an enlarged cross-sectional view of a portion of the well system of FIG. 1, according to one or more embodiments.

Referring now to FIG. 2, with continued reference to FIG. 1, illustrated is an enlarged cross-sectional view of a portion of the system 100 of FIG. 1, including one of the flow control devices 116 and a portion of one of the well screens 114, according to one or more embodiments. It should be noted that the flow control device 116 is depicted in simplified form for descriptive purposes only and therefore should not be considered limiting to the scope of the disclosure. As illustrated, the flow control device 116 may be arranged within or otherwise form an integral part of a housing 202 operably coupled to the base pipe 112. The well screen 114 may be coupled to or otherwise attached to the housing 202 and extend axially therefrom about the exterior of the base pipe 112. In some embodiments, the well screen 114 may be of the type known to those skilled in the art as a wire-wrapped well screen. In other embodiments, however, the well screen 114 may be any other type or combination of well screen such as, but not limited to, sintered screens, expandable screens, pre-packed screens, wire mesh screens, combinations thereof, and the like.

In some embodiments, the flow control device 116 may be defined in the housing 202, such as by machining the interior of the housing 202 or the like. In other embodiments, however, the flow control device 116 may be a separate mechanical component that may be installed or otherwise inserted into a cavity 204 suitably-defined in the housing 202 for the receipt of the flow control device 116. The flow control device 116 may be secured within the cavity 204 using several coupling methods or techniques known to those skilled in the art. For instance, the flow control device 116 may be installed and secured in the housing 202 by shrink-fitting, press-fitting, o-ring seals, mechanical fasteners, welding or brazing, industrial adhesives, threading, combinations thereof, and the like.

In exemplary operation, a fluid 206 (e.g., the fluid 122 of FIG. 1) from the annulus 120 may be drawn in or otherwise flow through the well screen 114 and is thereby filtered before flowing into an inlet 208 of the flow control device 116. In some embodiments, the fluid 206 may be a fluid composition originating from the surrounding formation 108 and may include one or more fluid components, such as oil and water, oil and gas, gas and water, oil, water and gas, etc.

In some embodiments, the flow control device 116 may include or otherwise exhibit a reduced-diameter flow chamber 210 along its axial length. The reduced-diameter flow chamber 210 may be configured to regulate fluid flow through the flow control device 116 by generating a pressure drop across the flow control device 116 that generally restricts the fluid flow therethrough.

After passing through the flow chamber 210, the fluid 206 may be discharged from the flow control device 116 via an outlet 212 that fluidly communicates with an adjacent chamber 214 defined in the housing 202. The fluid 206 exiting the flow control device 116 may exhibit an increased velocity as a result of the pressure drop caused by the reduction in area of the flow chamber 210. In some embodiments, the chamber 214 may be configured to receive and dissipate such fluid velocity before the fluid 206 is eventually conveyed to an interior 216 of the base pipe 112 for production purposes. Without the chamber 214, the high velocity fluid 206 may otherwise impinge upon or directly impact portions of the housing 202, thereby potentially causing detrimental erosion thereto and possibly resulting an eventual failure of the housing 202. As illustrated, the fluid 206 may exit the chamber 210 via a perforation 218 defined in the housing 202 and enter the base pipe 112 via one or more flow ports 220 defined in the base pipe 112. The perforation 218 and at least one of the flow ports 220 may be substantially aligned or otherwise coaxial such that fluid communication through the two is possible. In at least one embodiment, the perforation 218 may be a groove machined into the bottom of the housing 202.

While FIG. 2 depicts a single flow control device 116 being used in conjunction with a single well screen 114, those skilled in the art will readily appreciate that multiple flow control devices 116 may be used with one or multiple well screens 114, without departing from the scope of the disclosure. For instance, in some embodiments, multiple flow control devices 116 may be arranged in parallel within the housing 202 and configured to receive the fluid 206 from one or more well screens 114. In other embodiments, multiple flow control devices 116 may be arranged in series (e.g., outlet to inlet arrangement of flow control devices 116) within the housing 202 and configured to receive the fluid 206 in series sequence from one or more well screens 114. In some embodiments, the flow control device 116 may be arranged such that the fluid 206 flows through the flow control device 116 prior to flowing through the well screen 114. Accordingly, it will be appreciated that the principles of this disclosure are not limited to the details or structural configurations of the particular embodiment depicted in FIG. 2.

Figure 3:
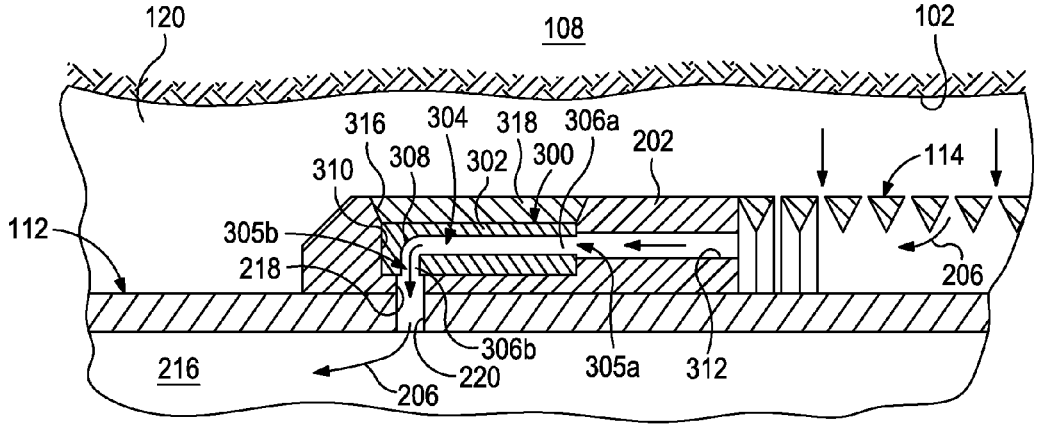
FIG. 3 illustrates a cross-sectional view of an exemplary flow control device, according to one or more embodiments.

Referring now to FIG. 3, with continued reference to FIGS. 1 and 2, illustrated is a cross-sectional view of an exemplary flow control device 300, according to one or more embodiments. The flow control device 300 may function somewhat similar to the flow control device 116 of FIG. 2 and therefore may be best understood with reference thereto. Particularly, the flow control device 300 may be configured to regulate the production of fluid 206 into the base pipe 112 by generating a pressure differential across the flow control device 300 that restricts fluid flow therethrough. In other embodiments, the flow control device 300 may likewise suitably operate in injection or stimulation operations where a fluid is injected into the surrounding formation 108 via the flow control device 300. Unlike the flow control device 116 of FIG. 2, however, the flow control device 300 may not discharge the fluid 206 into an adjacent chamber 214 (FIG. 2) defined in the housing 202. Instead, the flow control device 300 may be configured to convey the fluid 206 directly to the perforation 218 defined in the housing 202 and, consequently, to the port 220 defined in the base pipe 112.

As illustrated, the flow control device 300 may include a generally elongate body 302 having a flow chamber 304 defined or otherwise formed therein. The flow chamber 304 may have an inlet 305*a* and an outlet 305*b*, and the flow chamber 304 may extend therebetween. In some embodiments, the body 302 may be in the shape of an elongate cylinder. In other embodiments, however, the body 302 may be formed or otherwise shaped in other geometric configurations, such as an elongate prism or polyhedron (e.g., rectangular), without departing from the scope of the disclosure.

The body 302 may be made of one or more wear-resistant and/or erosion-resistant materials. In some embodiments, for example, the body 302 may be made of a carbide, such as tungsten carbide. In other embodiments, however, the body 302 may be made of other wear-resistant and/or erosion-resistant materials such as, but not limited to, ceramics, hardened steel, steel (or another metal or rigid material) coated or otherwise clad with an erosion-resistant coating or cladding, combinations thereof, and the like.

Similar to the flow chamber 210 of the flow control device 116 of FIG. 2, the flow chamber 304 may exhibit or otherwise provide a reduced-diameter or flow area configured to restrict fluid flow through the flow control device 300 and thereby regulate production into the base pipe 112 or injection into the surrounding formation 108. As illustrated, the flow chamber 304 may include a longitudinal portion 306*a* and a radial portion 306*b*. Specifically, the longitudinal portion 306*a* may be a length or section of the flow chamber 304 that extends longitudinally or otherwise generally parallel with respect to the base pipe 112, and the radial portion 306*b* may be a length or section of the flow chamber 304 that extends generally perpendicular in the radial direction with respect to the base pipe 112. In some embodiments, the inlet 305*a* may convey the fluid 206 into the longitudinal portion 306*a* and the outlet 305*b* may discharge the fluid 206 after having passed through the radial portion 306*b*. In other embodiments, however, the flow of the fluid 206 may be reversed such that the function of the inlet and outlet 305*a,b* may be reversed. In any event, the radial portion 306*b* may be fluidly coupled or aligned with the perforation 218 such that fluid communication through the flow chamber 304 and the perforation 218 and port 220 is effectively enabled.

In the illustrated embodiment, the longitudinal and radial portions 306*a,b* may be arranged generally orthogonal to one another. As will be discussed in greater detail below, however, the angular configuration between the longitudinal and radial portions 306*a,b* may vary from orthogonality, without departing from the scope of the disclosure. For instance, the longitudinal portion 306*a* may vary from extending generally parallel to the base pipe 112 to various angular configurations ranging between parallel and perpendicular thereto. Likewise, the radial portion 306*b* may vary from extending generally perpendicular to the base pipe 112 to various angular configurations ranging between perpendicular and parallel thereto.

The longitudinal and radial portions 306*a,b* may be fluidly coupled at an elbow 308 of the flow chamber 304, thereby providing a contiguous flow path for fluids 206 to flow through the flow control device 300 during operations (e.g., production, stimulation, injection, etc.). In some embodiments, as illustrated, the elbow 308 may provide an arcuate or smooth transition between the longitudinal and radial portions 306*a,b*. In other embodiments, however, the elbow 308 may provide an abrupt or sharp transition between the longitudinal and radial portions 306*a,b*, without departing from the scope of the disclosure.

The flow control device 300 may be arranged within a cavity 310 defined or formed in the housing 202. In the illustrated embodiment, the cavity 310 may include or otherwise be fluidly coupled to an inlet conduit 312 also defined in the housing 202. The inlet conduit 312 may generally be configured to place the cavity 310, or the flow control device 300, in fluid communication with the well screen 114. In other embodiments, however, as discussed below, the inlet conduit 312 may be omitted and the cavity 310, or the flow control device 300, may instead be in direct fluid communication with the well screen 114.

In the illustrated embodiment, the flow control device 300 may be inserted radially into the cavity 310 via an opening 316 defined in the housing 202. Once properly inserted or otherwise introduced into the cavity 310, the opening 316 may be occluded or otherwise sealed with a cap 318, thereby preventing removal of the flow control device 300 from the housing 202. In some embodiments, the cap 318 may be welded or brazed to the body 202, thereby securing the cap 318 thereto. In other embodiments, however, the cap 318 may be secured to the body 202 using one or more known attachment methods or techniques including, but not limited to, shrink-fitting, press-fitting, mechanical fasteners, mechanical coupling devices (e.g., snap rings and the like), industrial adhesives, threading, combinations thereof, and the like.

In one or more embodiments, the flow control device 300 may further be secured within the cavity 310 independent of the securing measure of the cap 318. For instance, the flow control device 300 may be installed and secured in the housing 202 by shrink-fitting or press-fitting the body 302 into the cavity 310 such that an interference fit is generated that prevents removal of the flow control device 300 therefrom. In other embodiments, however, the flow control device 300 may be installed and secured in the cavity 310 using o-ring seals, mechanical fasteners, mechanical coupling devices (e.g., snap rings and the like), welding, brazing, industrial adhesives, threading, combinations thereof, and the like.

In exemplary operation, as briefly mentioned above, the flow control device 300 may be configured to convey or otherwise channel the incoming fluid 206 directly to the perforation 218 defined in the housing 202 and, consequently, to the one or more ports 220 defined in the base pipe 112. As a result, the high-velocity fluid 206 exiting the flow chamber 304 may not impinge upon or otherwise directly impact portions of the housing 202 which could potentially cause detrimental erosion thereto and possibly result in the eventual failure of the housing 202. Since the body 302 of the flow control device 300 is made of a wear-resistant and/or erosion-resistant material, the high-velocity fluid 206 may have little or no impact on the body 302, such as suffering erosion or abrasion that would otherwise damage the flow chamber 304. Rather, the flow chamber 304 may simply be configured to receive and redirect the flow of the fluid 206.

Those skilled in the art will readily appreciate the advantages this may provide. Besides saving the housing 202 from damaging erosion caused by the high-velocity fluid 206, the flow control device 300 may also allow the housing 202 to be manufactured to a smaller size. In particular, since the flow chamber 304 redirects the flow of the fluid 206 directly to the perforation 218 and the port 220, there is no need for the chamber 214 (FIG. 2) which would otherwise require the housing 202 to be extended longitudinally in order to accommodate the axial length required for proper dissipation of the high-velocity fluid 206. As a result, a smaller package design may be provided, thereby decreasing manufacturing costs and complexity. As will be appreciated, the smaller package design may prove advantageous in downhole environments where space is often limited and valuable.

Figure 4:
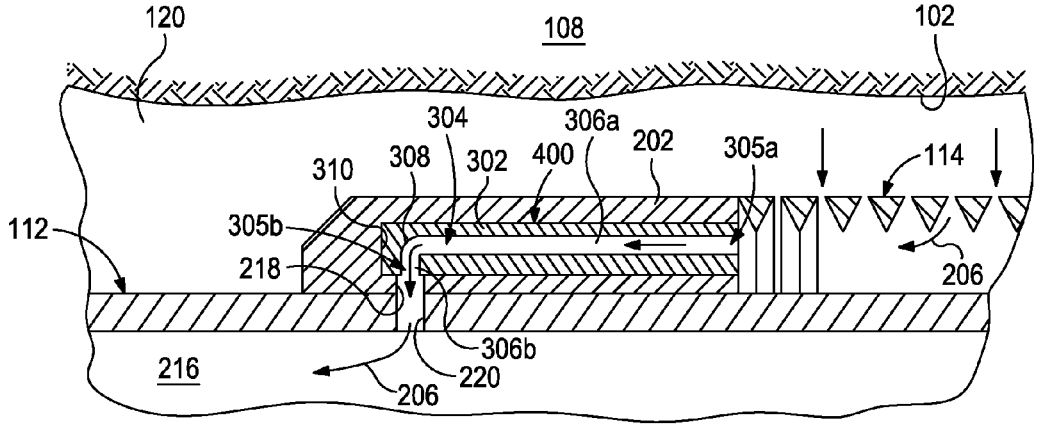
FIG. 4 illustrates a cross-sectional view of another exemplary flow control device, according to one or more embodiments.

Referring now to FIG. 4, with continued reference to FIG. 3, illustrated is a cross-sectional view of another exemplary flow control device 400, according to one or more embodiments. The flow control device 400 may be substantially similar to the flow control device 300 of FIG. 3 and therefore may be best understood with reference thereto, where like numerals indicate like components not described again in detail. Similar to the flow control device 300 of FIG. 3, the flow control device 400 may include the body 302 and the flow chamber 304 defined therein. Moreover, the body 302 may be arranged or otherwise secured within the cavity 310 defined in the housing 202.

Unlike the flow control device 300 of FIG. 3, however, the flow control device 400 may be inserted longitudinally or axially into the cavity 310 and appropriately secured therein. In some embodiments, for example, the cavity 310 may be defined or otherwise formed so as to exhibit a diameter or thickness that is slightly smaller than the diameter or thickness of the body 302. Upon heating the housing 202, the diameter or thickness of the cavity 310 may thermally expand, thereby allowing the body 302 to be inserted therein without obstruction. Once the housing 202 cools, an interference fit may be generated between the body 302 and the cavity 310, thereby immovably fixing the flow control device 300 within the housing 202.

In other embodiments, the diameter or thickness of the cavity 302 may be substantially the same if not slightly smaller than the diameter or thickness of the body 302 and the body 302 may be press-fit into the cavity, thereby also immovably fixing the flow control device 300 within the housing 202. In yet other embodiments, the flow control device 300 may be installed and secured in the cavity 310 using o-ring seals, mechanical fasteners, mechanical coupling devices (e.g., snap rings and the like), welding, brazing, industrial adhesives, threading, combinations thereof, and the like. Exemplary operation and advantages of the flow control device 400 may be substantially similar to the exemplary operation and advantages of the flow control device 300 of FIG. 3, as generally described above, and therefore will not be discussed again.

Figure 5:
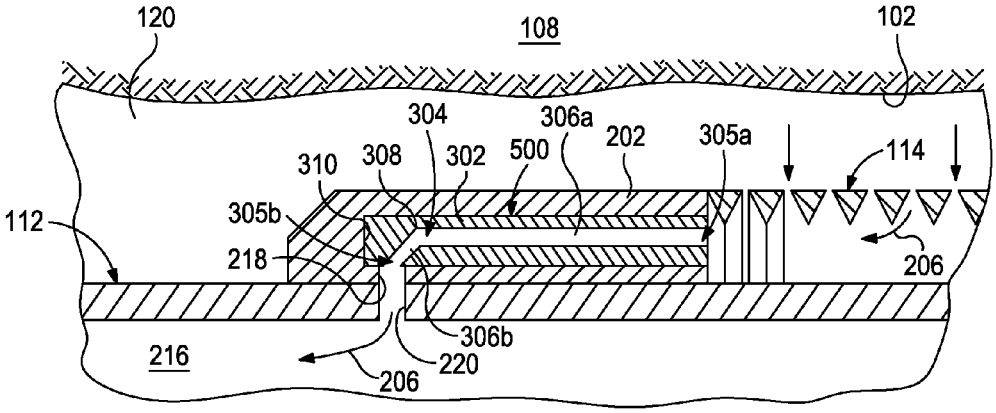
FIG. 5 illustrates a cross-sectional view of another exemplary flow control device, according to one or more embodiments.

Referring now to FIG. 5, with continued reference to FIGS. 3 and 4, illustrated is a cross-sectional view of another exemplary flow control device 500, according to one or more embodiments. The flow control device 500 may be similar in some respects to the flow control devices 300 and 400 of FIGS. 3 and 4, respectively, and therefore may be best understood with reference thereto where like numerals indicate like components not be described again in detail. Similar to the flow control devices 300 and 400, the flow control device 500 may include the body 302 and the flow chamber 304 defined therein. Moreover, the body 302 may be arranged or otherwise secured within the cavity 310 defined in the housing 202, as generally described above.

Unlike the flow control devices 300 and 400, however, the longitudinal and radial portions 306*a,b* of the flow chamber 304 may not be arranged orthogonal to one another. Rather, the radial portion 306*b* may extend from the longitudinal portion 306*a* at an angle between parallel and perpendicular to the base pipe 112. In the illustrated embodiment, for example, the radial portion 306*b* may extend from the longitudinal portion 306*a* at about a 45° angle with respect to the base pipe 112 or the longitudinal portion 306*a*. Those skilled in the art will readily appreciate that the angle between the longitudinal and radial portions 306*a,b* may be greater or less than 45°. For instance, the angle between the longitudinal and radial portions 306*a,b* may range anywhere between 0° and 45° or otherwise anywhere between 45° and 90°, without departing from the scope of the disclosure.

Moreover, while the elbow 308 is shown in FIG. 5 as being abrupt or sharp, it is equally contemplated herein to have an arcuate or smooth elbow 308 transition between the longitudinal and radial portions 306*a,b* shown in the flow control device 500. Exemplary operation and advantages of the flow control device 500 may be substantially similar to the exemplary operation and advantages of the flow control device 300 of FIG. 3, as generally described above, and therefore will not be discussed again.

Figure 6:
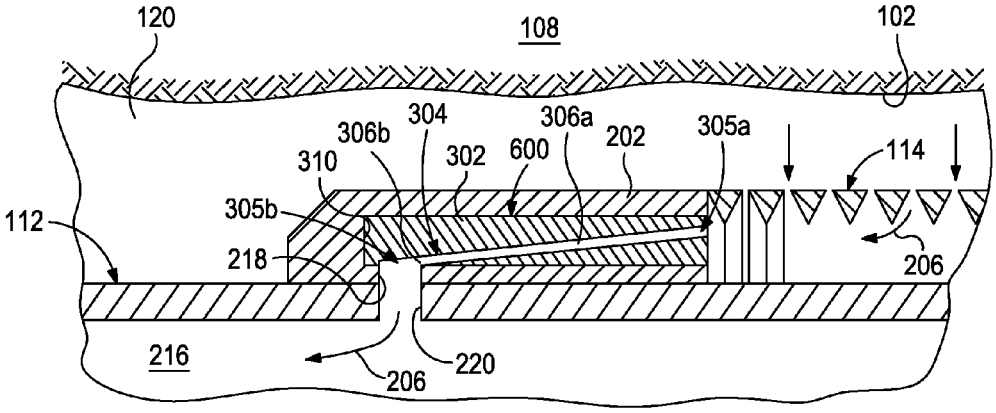
FIG. 6 illustrates a cross-sectional view of another exemplary flow control device, according to one or more embodiments.

Referring now to FIG. 6, with continued reference to FIGS. 3-5, illustrated is a cross-sectional view of another exemplary flow control device 600, according to one or more embodiments. The flow control device 600 may be similar in some respects to the flow control devices 300, 400, and 500 of FIGS. 3-5, respectively, and therefore may be best understood with reference thereto where like numerals indicate like components not described again in detail. Similar to the flow control devices 300, 400, and 500, the flow control device 600 may include the body 302 and the flow chamber 304 defined therein. Moreover, the body 302 may be arranged or otherwise secured within the cavity 310 defined in the housing 202, as generally described above.

Unlike the flow control devices 300, 400, and 500, however, the entire length of the flow chamber 304 of the flow control device 600 may be substantially linear or straight. Specifically, the longitudinal and radial portions 306*a,b* of the flow chamber 304 may be substantially aligned or otherwise coaxial with one another, and the elbow 308 may therefore be absent from the body 302. Moreover, the flow chamber 304 may be angled with respect to the base pipe 112 such that the radial portion 306*b* may continue to be fluidly coupled or otherwise aligned with the perforation 218 and able to deliver the fluid 206 directly thereto and, consequently, to the port 220 defined in the base pipe 112.

As a result, the flow control device 600 may be able to appropriately restrict fluid flow therethrough while simultaneously enjoying the advantages of directing fluid flow directly to the base pipe 112 and thereby avoiding damaging erosion or abrasion of the housing 202 caused by the high-velocity fluid 206 discharged from the flow chamber 304. Exemplary operation and advantages of the flow control device 600 may be substantially similar to the exemplary operation and advantages of the flow control device 300 of FIG. 3, as generally described above, and therefore will not be discussed again.

It should be noted that any of the exemplary flow control devices described herein may be inserted into and otherwise secured within the cavity 310 either radially, as described with reference to FIG. 3, or longitudinally, as described with reference to FIG. 4, without departing from the scope of the disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A flow control device, comprising:

a body fixed within a cavity defined in a housing coupled to a base pipe, the body having an inlet and an outlet and the housing defining a perforation permanently aligned in the radial direction, while in use, with the outlet and one or more flow ports defined in the base pipe to allow fluid communication therethrough; and a flow chamber defined within the body and having a longitudinal portion and a radial portion, the radial portion being fluidly coupled to the perforation such that a fluid flowing through the flow chamber is conveyed directly to or from the perforation and the one or more flow ports.

2. The flow control device of claim 1, wherein the body is at least one of an elongate cylinder and an elongate prism.

3. The flow control device of claim 1, wherein the body comprises an erosion-resistant material selected from the group consisting of carbides, ceramics, hardened steel, a metal or other rigid material coated with an erosion-resistant coating or cladding, and combinations thereof.

4. The flow control device of claim 1, wherein the longitudinal portion and the radial portion are fluidly coupled at an elbow defined in the body.

5. The flow control device of claim 4, wherein the longitudinal portion extends substantially parallel to the base pipe and the radial portion extends substantially perpendicular to the base pipe.

6. The flow control device of claim 4, wherein the longitudinal portion extends substantially parallel to the base pipe and the radial portion extends at an angle between parallel and perpendicular to the base pipe.

7. The flow control device of claim 1, wherein the longitudinal and radial portions are substantially aligned and the flow chamber is angled with respect to the base pipe.

8. The flow control device of claim 1, wherein the body is inserted into the cavity radially via an opening defined in the housing.

9. The flow control device of claim 8, wherein the opening is occluded with a cap secured to the housing for preventing removal of the body from the housing.

10. The flow control device of claim 1, wherein the body is inserted into the cavity longitudinally and secured therein using a technique selected from the group consisting of shrink-fitting, press-fitting, o-ring seals, mechanical fasteners, mechanical coupling devices, welding, brazing, industrial adhesives, threading, and combinations thereof.

11. A method of regulating a fluid flow, comprising:

receiving a fluid in a flow control device comprising a body fixed within a housing coupled to a base pipe, the body having an inlet and an outlet and the housing defining a perforation permanently aligned in the radial direction, while in use, with the outlet and one or more flow ports defined in the base pipe to allow fluid communication therethrough;

flowing the fluid through a flow chamber defined within the body, the flow chamber having a longitudinal portion and a radial portion; and conveying the fluid directly to or from the perforation and the one or more flow ports via the radial portion.

12. The method of claim 11, further comprising fluidly coupling the longitudinal portion and the radial portion at an elbow defined in the flow chamber.

13. The method of claim 12, wherein the longitudinal portion extends substantially parallel to the base pipe and the radial portion extends substantially perpendicular to the base pipe.

14. The method of claim 12, wherein the longitudinal portion extends substantially parallel to the base pipe and the radial portion extends at an angle between parallel and perpendicular to the base pipe.

15. A method of producing a fluid, comprising:

drawing the fluid through a well screen arranged about a base pipe, the base pipe having one or more flow ports defined therein and a housing coupled thereto, the housing defining a perforation radially aligned with the one or more flow ports to allow fluid communication therethrough;

receiving the fluid in a flow control device comprising a body fixed within the housing, the body having an inlet and an outlet, wherein the outlet is permanently aligned in the radial direction, while in use, with the perforation and the one or more flow ports;

flowing the fluid through a flow chamber defined in the body, the flow chamber having a longitudinal portion and a radial portion, wherein the radial portion is fluidly coupled to the perforation;

conveying the fluid directly to the perforation and the one or more flow ports via the radial portion; and receiving the fluid in an interior of the base pipe via the one or more flow ports.

16. The method of claim 15, further comprising restricting a flow of the fluid through the flow control device with the flow chamber.

17. The method of claim 15, further comprising fluidly coupling the longitudinal portion and the radial portion at an elbow defined in the flow chamber.

18. The method of claim 17, wherein the longitudinal portion extends substantially parallel to the base pipe and the radial portion extends substantially perpendicular to the base pipe.

19. The method of claim 17, wherein the longitudinal portion extends substantially parallel to the base pipe and the radial portion extends at an angle between parallel and perpendicular to the base pipe.

20. The method of claim 15, wherein the body is inserted longitudinally into a cavity defined in the housing, the method further comprising securing the body within the cavity using a technique selected from the group consisting of shrink-fitting, press-fitting, o-ring seals, mechanical fasteners, mechanical coupling devices, welding, brazing, industrial adhesives, threading, and combinations thereof.

* * * * *